US007930920B2

(12) United States Patent
Le Carpentier

(10) Patent No.: US 7,930,920 B2
(45) Date of Patent: Apr. 26, 2011

(54) METHOD FOR DESIGNING CLOTHING AND EQUIPMENT FOR LAW ENFORCEMENT, AND THE METHOD FOR HOMOLOGATING SUCH CLOTHING AND EQUIPMENT

(75) Inventor: Jérôme Le Carpentier, Broglie (FR)

(73) Assignee: Compagnie Europeenne de Developpement Industriel-CEDI (FR)

( * ) Notice: Subject to any disclaimer, the term of this patent is extended or adjusted under 35 U.S.C. 154(b) by 111 days.

(21) Appl. No.: 12/227,838

(22) PCT Filed: May 30, 2007

(86) PCT No.: PCT/EP2007/055259

§ 371 (c)(1),
(2), (4) Date: Nov. 26, 2008

(87) PCT Pub. No.: WO2007/138080

PCT Pub. Date: Dec. 6, 2007

(65) Prior Publication Data

US 2009/0288472 A1 Nov. 26, 2009

(30) Foreign Application Priority Data

May 30, 2006 (FR) ..... 06 04796
Jun. 15, 2006 (FR) ..... 06 05328
Nov. 16, 2006 (FR) ..... 06 10021

(51) Int. Cl.
*G01M 7/00* (2006.01)

(52) U.S. Cl. ..... 73/12.04; 73/12.09

(58) Field of Classification Search ..... 73/12.01–12.14
See application file for complete search history.

(56) References Cited

U.S. PATENT DOCUMENTS

| | | | | |
|---|---|---|---|---|
| 4,161,874 | A * | 7/1979 | Specker et al. | 73/12.01 |
| 4,349,339 | A * | 9/1982 | Daniel | 434/274 |
| 4,453,271 | A | 6/1984 | Donzis | |
| 5,325,537 | A | 7/1994 | Marion | |
| 5,485,758 | A * | 1/1996 | Brown et al. | 73/865.8 |
| 5,665,922 | A * | 9/1997 | Tsukada et al. | 73/849 |
| 5,716,302 | A * | 2/1998 | Andersson | 482/84 |
| 5,922,937 | A * | 7/1999 | Kowalski et al. | 73/12.14 |
| 6,561,007 | B1 * | 5/2003 | Bock et al. | 73/12.01 |
| 7,086,273 | B2 * | 8/2006 | Lipmyer | 73/12.09 |
| 7,204,165 | B1 * | 4/2007 | Plaga et al. | 73/866.4 |
| 7,527,568 | B2 * | 5/2009 | Joseph | 473/441 |

FOREIGN PATENT DOCUMENTS

| | | |
|---|---|---|
| EP | 1 459 854 | 9/2004 |
| WO | 95/18655 | 7/1995 |
| WO | 00/24276 | 5/2000 |

OTHER PUBLICATIONS

International Search Repot, PCT/EP2007/055259.

* cited by examiner

*Primary Examiner* — Max Noori
(74) *Attorney, Agent, or Firm* — Lerner, David, Littenberg, Krumholz & Mentlik, LLP

(57) ABSTRACT

A method for designing clothing and equipment for protecting law enforcement officers comprising the following steps: equipping a dummy with cinematic and/or load sensors, —positioning an impact application device to apply impacts on a target zone of the impact dummy, and the apply these impacts without the protection and the recording of the resulting measurements, the mounting of a form of protection on the target zone of the dummy, —the application of these impacts on the protected dummies, and the reading of the ensuing measurements, —the deduction of the energy absorbed from the measurements the value and/or attenuation of the impact force by the protection, —if the value(s) are superior to the threshold values, the clothing or equipment can be tagged as acceptable, —otherwise, structural modifications must be made to the protective clothing or equipment with the purpose of improving these values. Application of standardized tests for levels of protection in order to facilitate the choice of equipment for its intended usage.

28 Claims, 1 Drawing Sheet

Figure 1:
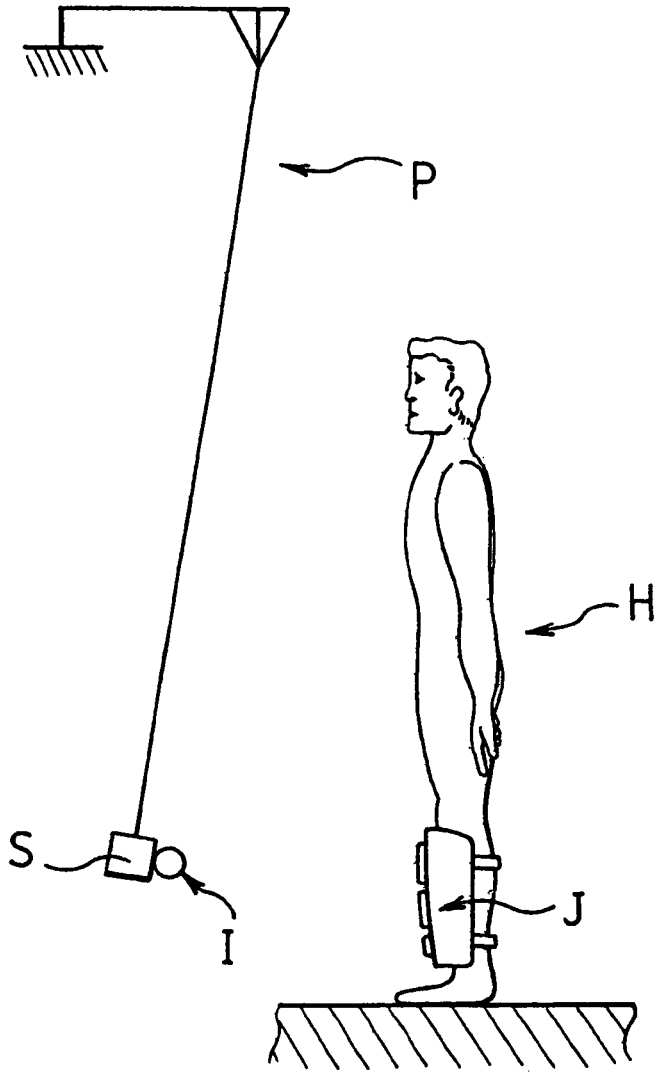

METHOD FOR DESIGNING CLOTHING AND EQUIPMENT FOR LAW ENFORCEMENT, AND THE METHOD FOR HOMOLOGATING SUCH CLOTHING AND EQUIPMENT

This invention generally relates to the designing of equipment for protecting law enforcement officers.

Equipment for protecting law enforcement officers here means any clothing or equipment worn by the user to reduce or prevent the risk of specific bodily damage.

Traditionally, such type of protecting equipment is designed substantially empirically: several prototypes are produced and tested either in actual conditions of wearing the equipment or close to actual conditions (taking care to not exert too much solicitation on the person carrying out the test).

This invention aims to overcome these limitations of prior art, and to propose methods that make it possible, by providing in particular an accurate and reproducible measurability of the protective effect of clothing or equipment for protecting on the human body, to facilitate the design of such clothing or equipment according to a desired protection objective, to improve their reliability and to offer users a range of clothing or equipment that can offer different degrees of protection, according to need.

As such the invention aims to implement a scientific approach to the evaluation of law enforcement equipment, resulting in the standardised expression of an evaluation in terms of traumatology, easy to read by the customer in that it allows him to choose objectively between such and such a type of equipment in relation to a calibrated level of protection, by starting for example with a club and ending with an ax.

To that effect, the invention proposes according to a first aspect a method for designing a clothing or equipment for protecting the body for law enforcement officers, characterised in that it comprises the following steps:

- provide a dummy with a set of kinematic and/or load sensors,
- position an impact application device in such a way that the latter can apply on at least one predetermined target zone of the dummy impacts according to a determined reproducible kinematic,
- apply said impacts on the target zone of dummy that is not provided with protective clothing or equipment, and take the measurements provided by the sensor(s) located in the region of said target zones,
- mount a protective clothing or equipment on the dummy in such a way that it covers the target zone,
- apply said impacts on the target zone of the dummy provided with the protective clothing or equipment, and take the measurements provided by said sensor(s),
- deduct from the measurements at least one value of energy absorbed and/or attenuation of the impact force by said protective clothing or equipment, and
- if said value(s) are higher than threshold values, tag the clothing or equipment as acceptable in the sense of said thresholds,
- otherwise, make structural modifications to said protective clothing or equipment in order to improve said values of energy absorbed and/or attenuation of the impact force.

According to a second aspect of the invention, a method of test homologating is also proposed for a clothing or equipment for protecting the body for law enforcement officers, characterised in that it comprises the following steps:

- provide a dummy with a set of kinematic and/or load sensors,

- position an impact application device in such a way that the latter can apply on at least one predetermined target zone of the dummy, likely to be protected by the clothing or equipment to be tested, impacts according to a determined reproducible kinematic,
- apply said impacts on the target zone of dummy that is not provided with protective clothing or equipment to be tested, and take the measurements provided by the sensor(s) located in the region of said target zones,
- mount the protective clothing or equipment to be tested on the dummy in such a way that it covers the target zone,
- apply said impacts on the target zone of the dummy provided with said clothing or equipment, and take the measurements provided by said sensor(s),
- deduct from the measurements at least one value of energy absorbed and/or attenuation of the impact force by said protective clothing or equipment, and
- if said value(s) are higher than threshold values, tag the clothing or equipment as homologated.

Certain preferred aspects, but not limitative, of these methods are as follows:

- the method further comprises a step of determining said threshold values according to numerical data reflecting the relation between traumatisms and values of impact force and/or energy applied directly on the determined zones of the human body.
- the impacts are applied using a straight-wire pendulum bearing a support for an impactor.
- the support comprises at least one kinematic and/or load sensor.
- the measurements provided by the sensor(s) are chosen from a group including displacement measurements, speed measurements, acceleration measurements, impact force measurements, and their changes according to time.
- the impacts are applied with an impactor having a form chosen from amongst the rounded forms or with sharp edges.
- the impacts are applied according to at least two different angles of incidence.
- one of the incidences is generally orthogonal to the surface of the dummy on the target.
- the impacts are applied on the dummy in several different postures of the latter.
- for a protective equipment of the shin pad type, the leg of the dummy provided with a shoe is placed against a realistic test surface in such a way as to simulate the frictional forces between the dummy and the ground.
- the dummy is a partial dummy with at least one articulated leg provided with a shoe and subjected to a weight in order to press against a test surface reproducing actual ground.
- the impacts are applied with an impactor provided with a sharp edge.
- the method comprises the sinking measurement of the impactor into the material of the clothing or equipment.
- the clothing and equipment for protecting are chosen from the group comprising shin pads, thigh pads, vests, and shoulder pads, arm guards.

Figure 2A:
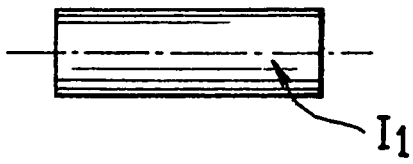
Figure 2B:
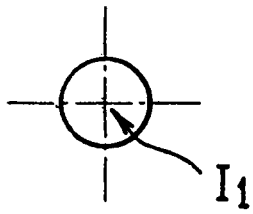
Figure 3A:
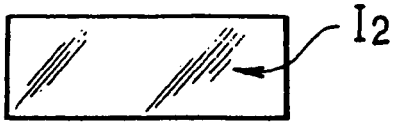
Figure 3B:
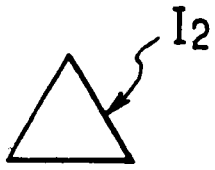

Other aspects, purposes and advantages of this invention shall appear better when reading the following detailed description of forms of preferred embodiments of the latter, provided by way of a non-limited example and in reference to the annexed drawings, wherein:

FIG. 1 is a general diagram of a test equipment according to the invention,

FIGS. 2*a* and 2*b* are side and end views of a first type of impactor used in the test equipment, and FIGS. 3*a* and 3*b* are side and end views of a second type of impactor used in the test equipment.

1) DEFINITIONS a) Protection zone: sector of the human body covered by the whole of a protective clothing or equipment and its accessories;

b) test zone: portion or zone(s) of a protective clothing or equipment that must be examined in particular;

c) targets: anatomical regions of the human body on which a blow is aimed; amongst these targets:

- the primary targets are generally considered as the forearms, buttocks, thighs, the back of the heel and the instep; these are mainly sectors where the masses of muscle protect the skeletal elements and which are devoid of vital organs;
- the secondary targets are generally considered as the back of the hands, the inside of the wrists, the elbow joints, the upper arms, the shoulders, the shoulder blades, the collar bone and the knee joints;
- finally the tertiary targets are generally considered as each portion of the face, of the skull, of the neck, the region of the vertebral column and of the rib, the sector just below the region of the rib, all of the liver, the solar plexus, the spleen, the kidneys, the lower abdomen, the groin and the coccyx.

d) incidence of a blow: this is defined by the hitting angle in relation to an axis normal to the general surface of the target (z axis), with the value of 0° corresponding to a front impact;

e) levels of performance: the level of performance of a clothing or equipment is a number used to provide an indication of the degree of protection procured by the clothing or equipment, such as determined by the performance tests such as shall be described in what follows; the higher the number, the higher the degree of performance is.

2) DESCRIPTION OF THE EQUIPMENT

This invention aims to design and test in terms of an official or private homologating of clothing or equipment for protecting the human body by proposing a test device making it possible to measure the decrease in the energy and in the impact force on such a clothing or equipment, this under the effect of an impactor simulating an actual blow.

For example, such an impactor can simulate a blow with a baseball bat or with an ax.

This test device comprises in an advantageous form of embodiment:

- a biomechanical dummy M;
- a test bench comprising a straight-wire pendulum P;
- an impactor I (here the baseball bat or the ax) mounted on the pendulum.

The dummy M simulates, to the limits of its precision, a human being of masculine sex, of a height of 175 cm and of a weight of 80 kg. It is instrumented, i.e. provided with a set of impact force sensors, time sensors, displacement sensors and acceleration sensors.

In this example of an embodiment, a dummy M is used having the following characteristics:

- Hybrid III frontally, having two channels which are a displacement sensor and an accelerometer;
- leg instrumented frontally with five channels, which are two impact force sensors, two time sensors and an accelerometer;
- femur instrumented frontally with four channels according to the EuroSID-2 standard, with two impact force sensors, a time sensor and an accelerometer;
- shoulder instrumented laterally with four channels according to the EuroSID-2 standard, with three impact force sensors and an accelerometer.

Note that these standardised definitions of dummies stemming in particular from legally-supervised automobile crash-test activities, are available with all of the implementation details needed by those skilled in the art from the official bodies involved (see in particular the Internet site www.inrets.fr of the Institut National de Recherche sur les Transports et leur Sécurité—French National Institute for Transport and Safety Research).

Such a dummy is provided with the protective clothing or equipment to be tested.

The test bench of the test device is here a straight-wire pendulum P whereon the impactor I is fixed. Such a pendulum simulates the hitting on an individual using this impactor. The pendulum has a cord length for example of 5 metres, which is advantageously adjustable.

The starting position and the mass of the impactor determine in a repeatable manner its speed of impact on the dummy, the force transmitted to the dummy and the energy impact.

As indicated hereinabove, the impactor can be one from amongst two types in this form of embodiment, i.e. a baseball bat or an ax.

In any case, the impactor comprises a base support S or metal frame (typically of steel) equipped with an accelerometer and a speed sensor.

The minimal mass of this base S is typically 2.5 kg.

On this base can be affixed an end of a suitable form forming the impactor properly speaking I in order to simulate the desired threat, i.e. here an end simulating the most corpulent portion of a baseball bat or simulating the blade of an ax (but as an alternative any other form of impactor that supposedly reflects the type of threat—such as a bamboo cane, bush knife, pruning knife, etc.).

In this particular embodiment, the end I1 simulating a baseball bat is shown in FIGS. 2*a* and 2*b*. It comprises a solid steel cylindrical barrel, of a length of 200 mm and a diameter of 50 mm, and of a Rockwell hardness of 55+/−3 (type C steel).

The end I2 simulating an ax blade is comprised of a steel bar, of identical hardness, having a section in the general form of an equilateral triangle of 5 mm on the side and a length of 200 mm, as shown in FIGS. 3*a* and 3*b* of the drawings.

Of course, other types of impactors can also be used, and in particular an impactor simulating the impact of a defence club of the tonfa type, on an iron bar, etc.

3) DESCRIPTION OF THE USE OF THE EQUIPMENT

The test device according to the invention is used in the following manner.

One of the two impactor models mounted on its base is first placed on the straight-wire pendulum, with the whole being positioned and maintained in such a way as to reach the energy, speed of impact and force desired. This maintaining is carried out in such a way as to be perfectly reproducible so that the impactor can touch the target respectively provided with its protection and deprived of its protection in the same conditions.

The protective clothing or equipment to be tested is first placed in an oven for 4 hours at 80° C., then stored at 20° C. for 48 hours at a relative humidity of 65%.

In the case where the test of the clothing or equipment must be carried out in different temperature or humidity conditions, then it is more preferably carried out within the 5 minutes following removal from storage, and lasting 20 minutes at the most.

The protective clothing or equipment to be tested is placed on the dummy such as described hereinabove, in such a way as to best reproduce the actual conditions. Typically, this clothing or equipment is positioned on the dummy and placed into contact with it with a contact force of approximately 20 to 30 N in the case where this force can be measured or estimated.

The dummy is then placed on the test bench positioned in such a way as to simulate the actual wearing of the clothing or equipment in a situation of law enforcement.

The test procedures can then be carried out, the initial choice residing in the desired values for the speed of impact, impact energy and the maximum force transmitted (in fact, the choice of an angle of incidence) as already mentioned.

For example, tests can be carried out with the end of the baseball bat type with the following parameters:

speed of impact: 5 m/s impact energy: 120 Joules incidence: 0° and 30° and with the end of the ax type with the following parameters:

speed of impact: 5 m/s impact energy: 50 Joules incidence: 0°.

It is understood that these parameters can vary according to the type of threat to which the wearer will be most frequently exposed, in particular in situations of law enforcement.

Moreover, an average force is advantageously used and transmitted differently according to the target under consideration, with for example a value less than 5 kN for the elbow or the cuisse, a value less than 8 kN for the upper arm, the forearm or the tibia, and a value less than 10 kN for the shoulder and the knee.

The tests are carried out on the different targets of the dummy and in particular:

- on a shin pad mounted fixed on a leg of the dummy between the knee (included) and the ankle, with targets on the top of the foot, the bottom of the tibia, the middle of the tibia, the top of the tibia and the knee;
- on a thigh pad fixed on the thigh of the dummy between the hip and the knee not included, with targets on the bottom of the thigh, the middle of the thigh and the top of the thigh;
- on a vest fixed on the trunk of dummy and provided with articulated protective shells for the shoulders and for the top of the upper arms as well as a bib for the pelvic zone, with targets in the corner of the shoulder, on the upper arm, on the solar plexus, on the kidneys, on the clavicles and on the pelvic zone;
- on a shoulder pad with articulated shells mounted on the shoulder (possibly retained by a vest as previously), with targets in the corner of the shoulder and on the upper arm;
- on an arm guard mounted on a forearm of the dummy, with targets on the wrist, on two regions of the forearm and on the elbow.

Of course, other tests are possible on other protective equipment or clothing.

The test procedure properly speaking consists in placing the dummy, devoid of any protective clothing or equipment, on a test surface such as a table or more generally any other fixed support fixe able to retain the dummy. Advantageously, the dummy is placed standing up on a test surface that reproduces the actual terrain (typically bitumen or cement for the protection of law enforcement officers in urban environments).

As indicated, the position of the dummy is adjusted in order to correspond to a realistic situation corresponding to the test. For example, for a shin pad test, the position of the dummy simulates a man standing up, and the contact pressure between the foot of the dummy and the test surface is adjusted in order to correspond to that that would be obtained with a man of normal weight; the sensors are calibrated, in a manner known per se in the field of automobile safety tests.

The position of the dummy is also adjusted so that the angle of incidence (orthogonal or oblique hit, see above) is that desired.

The straight-wire pendulum is then adjusted, and more precisely the point of departure and the load of the impactor (mass of the mobile portion) are adjusted in such a way as to obtain the speed, force and energy impact desired. A marking is carried out so that this point of departure, for a given series of tests, can be determined in a reproducible manner.

The tests on the preselected targets are then carried out, first on the dummy devoid of the protective clothing or equipment.

Then the clothing or equipment is placed on the corresponding zone of the dummy, and the tests are carried out again with the same speed, forces and energies.

Preferentially each individual test, without protection then with protection, comprises a measurement of the acceleration (in $m/s^2$) according to time (in s), of the stress (in daN) according to time (in s) and of the displacement (in m) according to time on sensors that instrument the dummy.

Each test also comprises a measurement, on the impactor, of the acceleration (in $m/s^2$) according to time (in s).

Preferably, during a test on a shin pad, a test is first carried out by placing the leg of the dummy in such a way that it cannot back up (using a wedge), then a test wherein the leg is authorised to back up (knowing that it is then important to obtain realistic frictional forces between the foot and the ground, which allows for the use of a material of the bitumen or cement type for the test surface).

Furthermore, the different tests are advantageously carried out in several different positions of the dummy, typically a position of attack, a position of defence and a static position.

All of the measures hereinabove are carried out with the impactor simulating a baseball bat.

As indicated hereinabove, other tests with one of the impactors simulating for example a tonfa or an iron bar can be carried out, with in this case a procedure similar to that used with the impactor simulating a baseball bat.

The data provided by the sensors with during the tests with the different impactors on the different targets is recorded. As such, a series of measurements is thus obtained which makes it possible for designers of equipment and clothing to progressively improve the behaviour of the latter.

More precisely, this recorded data is reprocessed, especially by comparing the data collected during impacts directly on the dummy (without the protection) and during impacts on the protection placed on the dummy. As such, an energy absorption coefficient can in particular be calculated as well as an attenuation coefficient of the force transmitted to the different target points.

The series of tests also comprises the use of the impactor simulating an ax. In this case, no measurement is taken on sensors, but, simply and manually, the sinking depth of the blade is measured. To that effect, the protective equipment or clothing is positioned not on the dummy, but on a rigid and fixed anvil, and the impactor of the ax type is applied with the force, speed and energy desired.

The process for validating the designing of protective clothing or equipment can be based on the comparison of these coefficients with pre-established thresholds, according to calculation rules that can indeed vary (by target, in a global manner, etc.).

Advantageously, these threshold values are based on numerical medical data, provided in particular by practitioners or experts specialising in traumatology, reflecting the relation between traumatisms and the values of impact force and/or energy applied directly on determined zones of the human body. More precisely and in what relates to bone fractures for example, it is known today relatively precisely for a certain number of regions of the human body, what level of force and/or energy is likely to result in a bone fracture.

With this, the minimum threshold value for an absorption by the protective equipment or clothing in a certain zone of the body is obtained by the difference between the force and/or the energy effectively applied by the impact application device and the force and/or the maximum energy that can be received by the zone under consideration without a certain traumatism (fracture, but also other forms of traumatisms) having the risk of appearing.

The designer can work in particular with the nature and the mechanical properties of the materials used (rigid plastic materials, padded canvases) and on their dimensional parameters, mainly in terms of thickness.

Of course, those skilled in the art will know how to make numerous alternatives and modifications to the invention.

In particular, in order to simplify the implementation of the invention in the case where a particular piece of protective equipment is of interest, a partially instrumented dummy can be designed. For example, in order to test shin pads, two artificial legs articulated on the knee can be provided, and a weight for example of 40 kg on each leg. The legs are then provided with shoes in such a way as to have with the chosen surface the frictional forces sought.

Plus generally, those skilled in the art will know how to carry out the adaptations needed to reproduce the realistic conditions wherein operate the law enforcement officers and therefore obtain reliable tests.

The invention claimed is:

1. A method for designing protective clothing or equipment for protecting the body for law enforcement officers, the method comprising:

provide a dummy with a set of at least one or both of (a) kinematic or (b) load sensors, position an impact application device in such a way that the latter can apply on at least one predetermined target zone of the dummy impacts according to a determined reproducible kinematic, apply said impacts on the target zone of dummy that is not provided with protective clothing or equipment, and take the measurements provided by the set of sensors located in the region of said target zones, mount a protective clothing or equipment on the dummy in such a way that it covers the target zone, apply said impacts on the target zone of the dummy provided with the protective clothing or equipment, and take the measurements provided by said set of sensors, deduct from the measurements at least one deduced value of at least one or both of (a) energy absorbed or (b) attenuation of the impact force by said protective clothing or equipment, and if said at least one values is higher than a threshold value, tag the clothing or equipment as acceptable in the sense of said thresholds, otherwise, make structural modifications to said protective clothing or equipment in order to improve said at least one deduced value of at least one or both of (a) energy absorbed or (b) attenuation of the impact force.

2. A method of test homologating a protective clothing or equipment for protecting the body for law enforcement officers, the method comprising:

provide a dummy with a set of at least one or both of (a) kinematic or (b) load sensors, position an impact application device in such a way that the latter can apply on at least one predetermined target zone of the dummy, likely to be protected by the clothing or equipment to be tested, impacts according to a determined reproducible kinematic, apply said impacts on the target zone of dummy that is not provided with protective clothing or equipment to be tested, and take the measurements provided by the set of sensors located in the region of said target zones, mount the protective clothing or equipment to be tested on the dummy in such a way that it covers the target zone, apply said impacts on the target zone of the dummy provided with said clothing or equipment, and take the measurements provided by said set of sensors, deduct from the measurements at least one deduced value of at least one or both of (a) energy absorbed or (b) attenuation of the impact force by said protective clothing or equipment, and if said at least one values are higher than a threshold value, tag the clothing or equipment as homologated.

3. The method of claim 1, further comprising a step of determining said threshold values according to numerical data reflecting the relation between traumatisms and values of at least one or both of (a) impact force or (b) energy applied directly on the determined zones of the human body.

4. The method of claim 1, wherein the impacts are applied using a straight-wire pendulum bearing a support for an impactor.

5. The method according to claim 4, wherein the support comprises at least one or both of a (a) kinematic or (b) load sensor.

6. The method of claim 1, wherein the measurements provided by the sensor(s) are chosen from a group including displacement measurements, speed measurements, acceleration measurements, impact force measurements, and their changes according to time.

7. The method according of claim 1, wherein the impacts are applied with an impactor having a form chosen from amongst the rounded forms or with sharp edges.

8. The method according to claim 7, wherein the impacts are applied according to at least two different angles of incidence.

9. The method according to claim 8, wherein one of the incidences is generally orthogonal to the surface of the dummy on the target.

10. The method of claim 1, wherein the impacts are applied on the dummy in several different postures of the latter.

11. The method of claim 1, wherein, for a protective equipment of a shin pad type, a leg of the dummy provided with a shoe is placed against a realistic test surface in such a way as to simulate frictional forces between the dummy and the ground.

12. The method according to claim 11, wherein the dummy is a partial dummy with at least one articulated leg provided with a shoe and subjected to a weight in order to press against a test surface reproducing actual ground.

13. The method of claim 1, wherein the impacts are applied with an impactor provided with a sharp edge.

14. The method according to claim 13, wherein the set of sensors measures the driving in of the impactor into the material of the clothing or equipment.

15. The method of claim 1, wherein the clothing and equipment for protecting the body are chosen from the group consisting of shin pads, thigh pads, vests, and shoulder pads, and arm guards.

16. The method of claim 2, wherein the method further comprises a step of determining said threshold values according to numerical data reflecting the relation between traumatisms and values of at least one or both of (a) impact force or (b) energy applied directly on the determined zones of the human body.

17. The method of claim 2, wherein the impacts are applied using a straight-wire pendulum bearing a support for an impactor.

18. The method of claim 2, wherein the support comprises at least one or both of a (a) kinematic or (b) load sensor.

19. The method of claim 2, wherein the measurements provided by the set of sensors are chosen from a group including displacement measurements, speed measurements, acceleration measurements, impact force measurements, and their changes according to time.

20. The method of claim 2, wherein the impacts are applied with an impactor having a form chosen from amongst the rounded forms or with sharp edges.

21. The method of claim 20, wherein the impacts are applied according to at least two different angles of incidence.

22. The method of claim 21, wherein one of the incidences is generally orthogonal to the surface of the dummy on the target.

23. The method of claim 2, wherein the impacts are applied on the dummy in several different postures of the latter.

24. The method of claim 2, wherein, for a protective equipment of a shin pad type, a leg of the dummy provided with a shoe is placed against a realistic test surface in such a way as to simulate frictional forces between the dummy and the ground.

25. The method of claim 24, wherein the dummy is a partial dummy with at least one articulated leg provided with a shoe and the method further comprises subjecting the dummy to a weight in order to press against a test surface reproducing actual ground.

26. The method of claim 2, wherein the impacts are applied with an impactor provided with a sharp edge.

27. The method of claim 26, wherein the set of sensors measures the driving in of the impactor into the material of the clothing or equipment.

28. The method of claim 2, wherein the clothing and equipment for protecting the body are chosen from the group comprising shin pads, thigh pads, vests, and shoulder pads, arm guards.

* * * * *